US007925503B2

(12) United States Patent
Croak et al.

(10) Patent No.: US 7,925,503 B2
(45) **Date of Patent: *Apr. 12, 2011**

(54) METHOD AND APPARATUS FOR DYNAMICALLY PROVIDING COMFORT NOISE

(75) Inventors: Marian Croak, Fair Haven, NJ (US); Hossein Eslambolchi, Los Altos Hills, CA (US)

(73) Assignee: AT&T Intellectual Property II, L.P., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/647,474

(22) Filed: Dec. 26, 2009

(65) Prior Publication Data

US 2010/0098064 A1 Apr. 22, 2010

Related U.S. Application Data

(63) Continuation of application No. 11/239,740, filed on Sep. 29, 2005, now Pat. No. 7,668,714.

(51) Int. Cl.
*G10L 21/02* (2006.01)

(52) U.S. Cl. ..... 704/228; 704/210; 704/215

(58) Field of Classification Search ..... 704/226, 704/227, 208, 210, 214, 215, 270, 228
See application file for complete search history.

(56) References Cited

U.S. PATENT DOCUMENTS

| | | | | |
|---|---|---|---|---|
| 5,485,522 | A * | 1/1996 | Solve et al. | 381/56 |
| 6,754,620 | B1 * | 6/2004 | Bauer | 704/214 |
| 7,023,986 | B2 * | 4/2006 | Scalart et al. | 379/406.05 |
| 7,668,714 | B1 | 2/2010 | Croak et al. | |

* cited by examiner

*Primary Examiner* — Huyen X. Vo

(57) ABSTRACT

A method and apparatus for dynamically enabling the activation and deactivation of comfort noise over a VoIP media path or channel are disclosed. The present method detects all sound levels in the media path and only activates the comfort noise in the absence of sound and when the background noise level or the telephone line noise level is low rather than only in the absence of speech.

12 Claims, 4 Drawing Sheets

METHOD AND APPARATUS FOR DYNAMICALLY PROVIDING COMFORT NOISE

This application is a continuation of U.S. patent application Ser. No. 11/239,740, filed Sep. 29, 2005, now U.S. Pat. No. 7,668,714 B1, and is herein incorporated by reference in its entirety.

The present invention relates generally to communication networks and, more particularly, to a method and apparatus for dynamically providing comfort noise in communication networks, e.g., packet networks such as Voice over Internet Protocol (VoIP) networks.

BACKGROUND OF THE INVENTION

When two callers are engaging in a conversation on the phone, the conversation flow comprises of a series of periods of presence of speech and periods of absence of speech. During the absence of speech periods, comfort noise that mimics the normal background noise of the phone call is typically introduced to maintain a natural conversation flow between the two callers. The comfort noise is typically a low level artificially created noise. If comfort noise is not used, a caller may think that the other party may have been disconnected due to complete silence, or "dead air", during the absence of speech periods. Although the insertion of comfort noise facilitates the communication experience in quiet environments where the background noise or the telephone line noise are low or negligible, this comfort noise can become very unpleasant and even reduce speech intelligibility in a noisy environments where the background noise or the telephone line noise is high. In a high background noise or telephone line noise environment, if the background noise abruptly disappears due to the insertion of comfort noise to replace the absence of speech periods, the switching between presence of speech periods with high level background noise and absence of speech periods with low level comfort noise can actually impair natural conversations.

Therefore, a need exists for a method and apparatus for dynamically providing comfort noise in a packet network, e.g., a VoIP network.

SUMMARY OF THE INVENTION

In one embodiment, the present invention dynamically enables the activation and deactivation of comfort noise over a VoIP media path or channel. The invention detects all sound levels in the media path and only activates the comfort noise in the absence of sound or when the background noise level is low rather than only in the absence of speech. For instance, in a noisy environment with high background noise or telephone line noise level, during periods with the absence of speech, a high level of background noise is still present. In this scenario, the present invention will not insert comfort noise in the media path even when speech is absent. In contrast, in a quiet environment with low background noise or telephone line noise level, during periods with the absence of speech, only a low level of background noise is present. In this scenario, the present invention will insert comfort noise in the media path when speech is absent to maintain natural conversation flows.

BRIEF DESCRIPTION OF THE DRAWINGS

The teaching of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
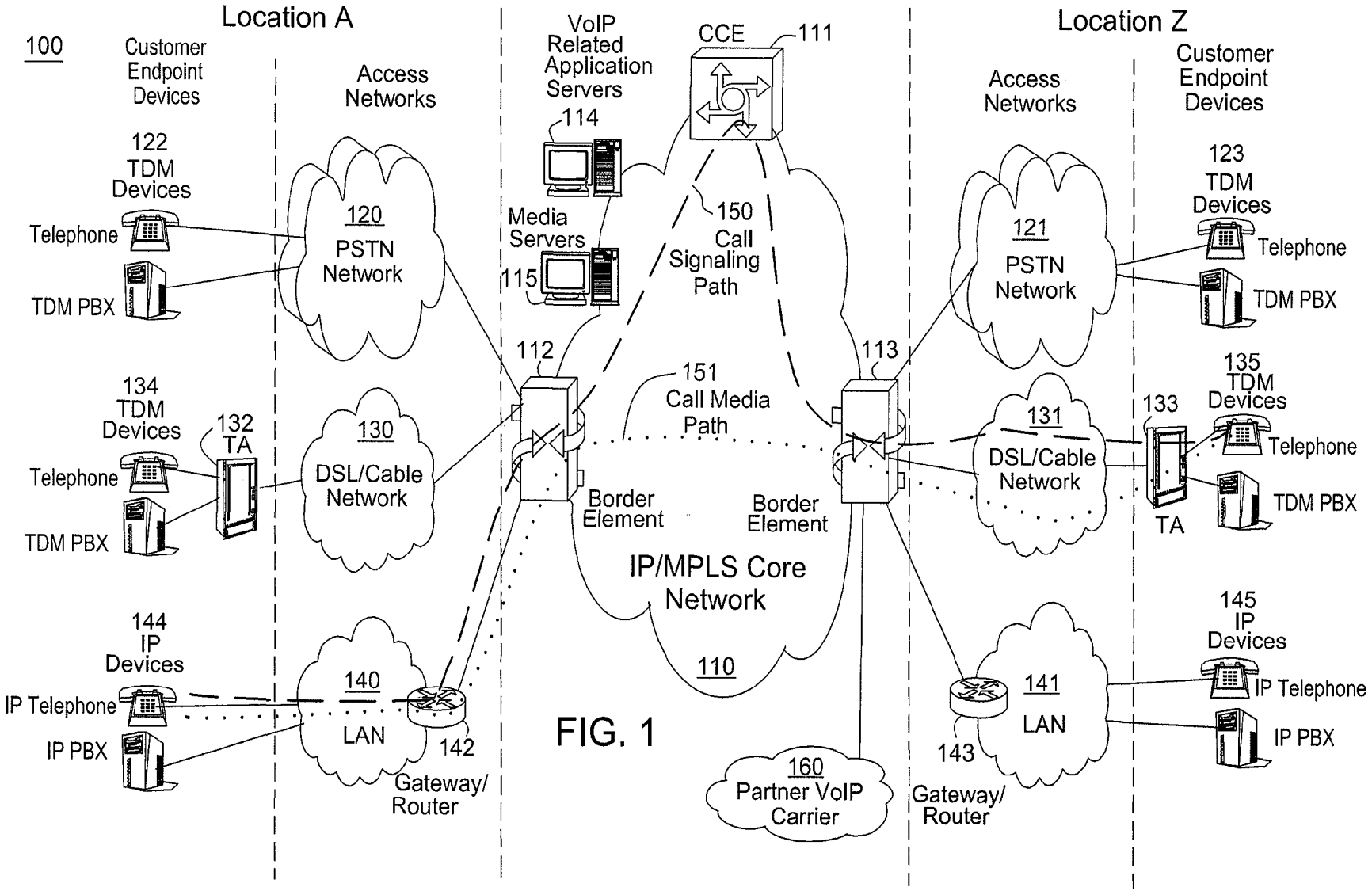
FIG. 1 illustrates an exemplary Voice over Internet Protocol (VoIP) network related to the present invention.

To better understand the present invention, FIG. 1 illustrates an example network, e.g., a packet network such as a VoIP network related to the present invention. Exemplary packet networks include internet protocol (IP) networks, asynchronous transfer mode (ATM) networks, frame-relay networks, and the like. An IP network is broadly defined as a network that uses Internet Protocol to exchange data packets. Thus, a VoIP network or a SoIP (Service over Internet Protocol) network is considered an IP network.

In one embodiment, the VoIP network may comprise various types of customer endpoint devices connected via various types of access networks to a carrier (a service provider) VoIP core infrastructure over an Internet Protocol/Multi-Protocol Label Switching (IP/MPLS) based core backbone network. Broadly defined, a VoIP network is a network that is capable of carrying voice signals as packetized data over an IP network. The present invention is described below in the context of an illustrative VoIP network. Thus, the present invention should not be interpreted to be limited by this particular illustrative architecture.

The customer endpoint devices can be either Time Division Multiplexing (TDM) based or IP based. TDM based customer endpoint devices 122, 123, 134, and 135 typically comprise of TDM phones or Private Branch Exchange (PBX). IP based customer endpoint devices 144 and 145 typically comprise IP phones or IP PBX. The Terminal Adaptors (TA) 132 and 133 are used to provide necessary interworking functions between TDM customer endpoint devices, such as analog phones, and packet based access network technologies, such as Digital Subscriber Loop (DSL) or Cable broadband access networks. TDM based customer endpoint devices access VoIP services by using either a Public Switched Telephone Network (PSTN) 120, 121 or a broadband access network via a TA 132 or 133. IP based customer endpoint devices access VoIP services by using a Local Area Network (LAN) 140 and 141 with a VoIP gateway or router 142 and 143, respectively.

The access networks can be either TDM or packet based. A TDM PSTN 120 or 121 is used to support TDM customer endpoint devices connected via traditional phone lines. A packet based access network, such as Frame Relay, ATM, Ethernet or IP, is used to support IP based customer endpoint devices via a customer LAN, e.g., 140 with a VoIP gateway and router 142. A packet based access network 130 or 131, such as DSL or Cable, when used together with a TA 132 or 133, is used to support TDM based customer endpoint devices.

The core VoIP infrastructure comprises of several key VoIP components, such the Border Element (BE) 112 and 113, the Call Control Element (CCE) 111, VoIP related Application Servers (AS) 114, and Media Server (MS) 115. The BE resides at the edge of the VoIP core infrastructure and interfaces with customers endpoints over various types of access networks. A BE is typically implemented as a Media Gateway and performs signaling, media control, security, and call admission control and related functions. The CCE resides within the VoIP infrastructure and is connected to the BEs using the Session Initiation Protocol (SIP) over the underlying IP/MPLS based core backbone network 110. The CCE is typically implemented as a Media Gateway Controller or a softswitch and performs network wide call control related functions as well as interacts with the appropriate VoIP service related servers when necessary. The CCE functions as a SIP back-to-back user agent and is a signaling endpoint for all call legs between all BEs and the CCE. The CCE may need to interact with various VoIP related Application Servers (AS) in order to complete a call that require certain service specific features, e.g. translation of an E.164 voice network address into an IP address.

For calls that originate or terminate in a different carrier, they can be handled through the PSTN 120 and 121 or the Partner IP Carrier 160 interconnections. For originating or terminating TDM calls, they can be handled via existing PSTN interconnections to the other carrier. For originating or terminating VoIP calls, they can be handled via the Partner IP carrier interface 160 to the other carrier.

In order to illustrate how the different components operate to support a VoIP call, the following call scenario is used to illustrate how a VoIP call is setup between two customer endpoints. A customer using IP device 144 at location A places a call to another customer at location Z using TDM device 135. During the call setup, a setup signaling message is sent from IP device 144, through the LAN 140, the VoIP Gateway/Router 142, and the associated packet based access network, to BE 112. BE 112 will then send a setup signaling message, such as a SIP-INVITE message if SIP is used, to CCE 111. CCE 111 looks at the called party information and queries the necessary VoIP service related application server 114 to obtain the information to complete this call. In one embodiment, the Application Server (AS) functions as a SIP back-to-back user agent. If BE 113 needs to be involved in completing the call; CCE 111 sends another call setup message, such as a SIP-INVITE message if SIP is used, to BE 113. Upon receiving the call setup message, BE 113 forwards the call setup message, via broadband network 131, to TA 133. TA 133 then identifies the appropriate TDM device 135 and rings that device. Once the call is accepted at location Z by the called party, a call acknowledgement signaling message, such as a SIP 200 OK response message if SIP is used, is sent in the reverse direction back to the CCE 111. After the CCE 111 receives the call acknowledgement message, it will then send a call acknowledgement signaling message, such as a SIP 200 OK response message if SIP is used, toward the calling party. In addition, the CCE 111 also provides the necessary information of the call to both BE 112 and BE 113 so that the call data exchange can proceed directly between BE 112 and BE 113. The call signaling path 150 and the call media path 151 are illustratively shown in FIG. 1. Note that the call signaling path and the call media path are different because once a call has been setup up between two endpoints, the CCE 111 does not need to be in the data path for actual direct data exchange.

Media Servers (MS) 115 are special servers that typically handle and terminate media streams, and to provide services such as announcements, teleconference bridges, transcoding, and Interactive Voice Response (IVR) messages for VoIP service applications.

Note that a customer in location A using any endpoint device type with its associated access network type can communicate with another customer in location Z using any endpoint device type with its associated network type as well. For instance, a customer at location A using IP customer endpoint device 144 with packet based access network 140 can call another customer at location Z using TDM endpoint device 123 with PSTN access network 121. The BEs 112 and 113 are responsible for the necessary signaling protocol translation, e.g., SS7 to and from SIP, and media format conversion, such as TDM voice format to and from IP based packet voice format.

When two callers are engaging in a conversation on the phone, the conversation flow comprises of a series of periods of presence of speech and periods of absence of speech. During the absence of speech periods, comfort noise that mimics the normal background noise of the phone call is typically introduced to maintain a natural conversation flow between the two callers. The comfort noise is typically a low level artificially created noise. If comfort noise is not used, a caller may think that the other party may have been disconnected due to complete silence, or "dead air", during the absence of speech periods. Although the insertion of comfort noise facilitates the communication experience in quiet environments where the background noise or the telephone line noise are low or negligible, this comfort noise can be become very unpleasant and even reduce speech intelligibility in a noisy environments where the background noise or the telephone line noise is high. In a high background noise or telephone line noise environment, if the background noise abruptly disappears due to the insertion of comfort noise to replace the absence of speech periods, the switching between presence of speech periods with high level background noise and absence of speech periods with low level comfort noise can actually impair natural conversations.

To address this criticality, the present invention dynamically enables the activation and deactivation of comfort noise over a VoIP media path or channel. The invention detects all sound levels in the media path and only activates the comfort noise in the absence of sound or when the background noise level is low rather than only in the absence of speech. For instance, in a noisy environment with high background noise or telephone line noise level, during periods with the absence of speech, a high level of background noise is still present. In this scenario, the present invention will not insert comfort noise in the media path even when speech is absent. In contrast, in a quiet environment with low background noise or telephone line noise level, during periods with the absence of speech, only a low level of background noise is present. In this scenario, the present invention will insert comfort noise in the media path when speech is absent to maintain natural conversation flows.

Figure 2:
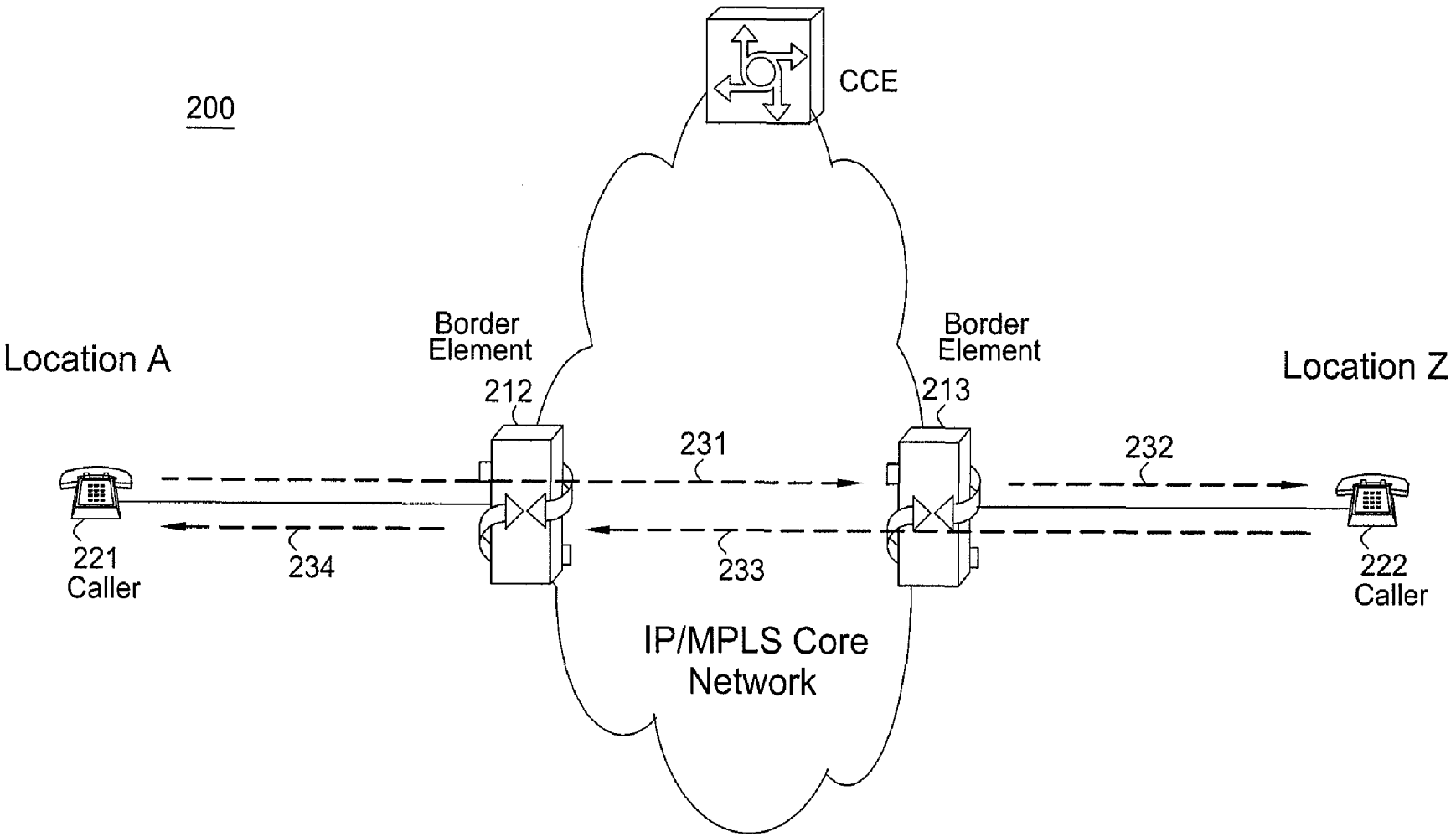
FIG. 2 illustrates an example of dynamically enabling comfort noise in a VoIP network of the present invention.

FIG. 2 illustrates an exemplary communication architecture 200 for dynamically enabling comfort noise in a packet network, e.g., a VoIP network of the present invention. In FIG. 2, caller 221 at location A is engaging in a conversation with caller 222 at location Z. In the A to Z direction, conversation flow is carried over the media path that comprises of media path segment 231 and media path segment 232. In the Z to A direction, conversation flow is carried over the media path that comprises of media path segment 233 and media path segment 234.

In the A to Z direction, BE 213, or a speech activity detector attached to BE 213, constantly monitors the speech activities as well as the background noise and telephone line noise levels. During absence of speech periods, BE 213 dynamically determines if comfort noise should be inserted into the media path to replace the background noise. For instance, during periods of absence of speech, BE 213 monitors the background noise or the telephone line noise level of media path segment 231. During absence of speech periods, if the monitored background noise or the telephone line noise level of media path segment 231 exceeds a predefined noise level threshold, BE 213 will not introduce comfort noise to replace existing background noise or telephone line noise from media path 231. In other words, the background noise or the telephone line noise from media path segment 231 will be transmitted over media path segment 232 to caller 222. During absence of speech periods, if the monitored background noise or the telephone line noise level of media path 231 does not exceed the predefined noise level threshold, BE 213 will introduce comfort noise into media path segment 232 to caller 222 to replace existing background noise or telephone line noise from media path 231.

Similarly, in the Z to A direction, BE 212, or a speech activity detector attached to BE 212, constantly monitors the speech activities as well as the background noise and telephone line noise levels. During absence of speech periods, BE 212 dynamically determines if comfort noise should be inserted into the media path to replace the background noise. For instance, during periods of absence of speech, BE 212 monitors the background noise or the telephone line noise level of media path segment 233. During absence of speech periods, if the monitored background noise or the telephone line noise level of media path segment 233 exceeds a predefined noise level threshold, BE 212 will not introduce comfort noise to replace existing background noise or telephone line noise from media path 233. In other words, the background noise or the telephone line noise from media path segment 233 will be transmitted over media path segment 234 to caller 221. During absence of speech periods, if the monitored background noise or the telephone line noise level of media path 233 does not exceed the predefined noise level threshold, BE 212 will introduce comfort noise into media path segment 234 to caller 221 to replace existing background noise or telephone line noise from media path 233.

Figure 3:
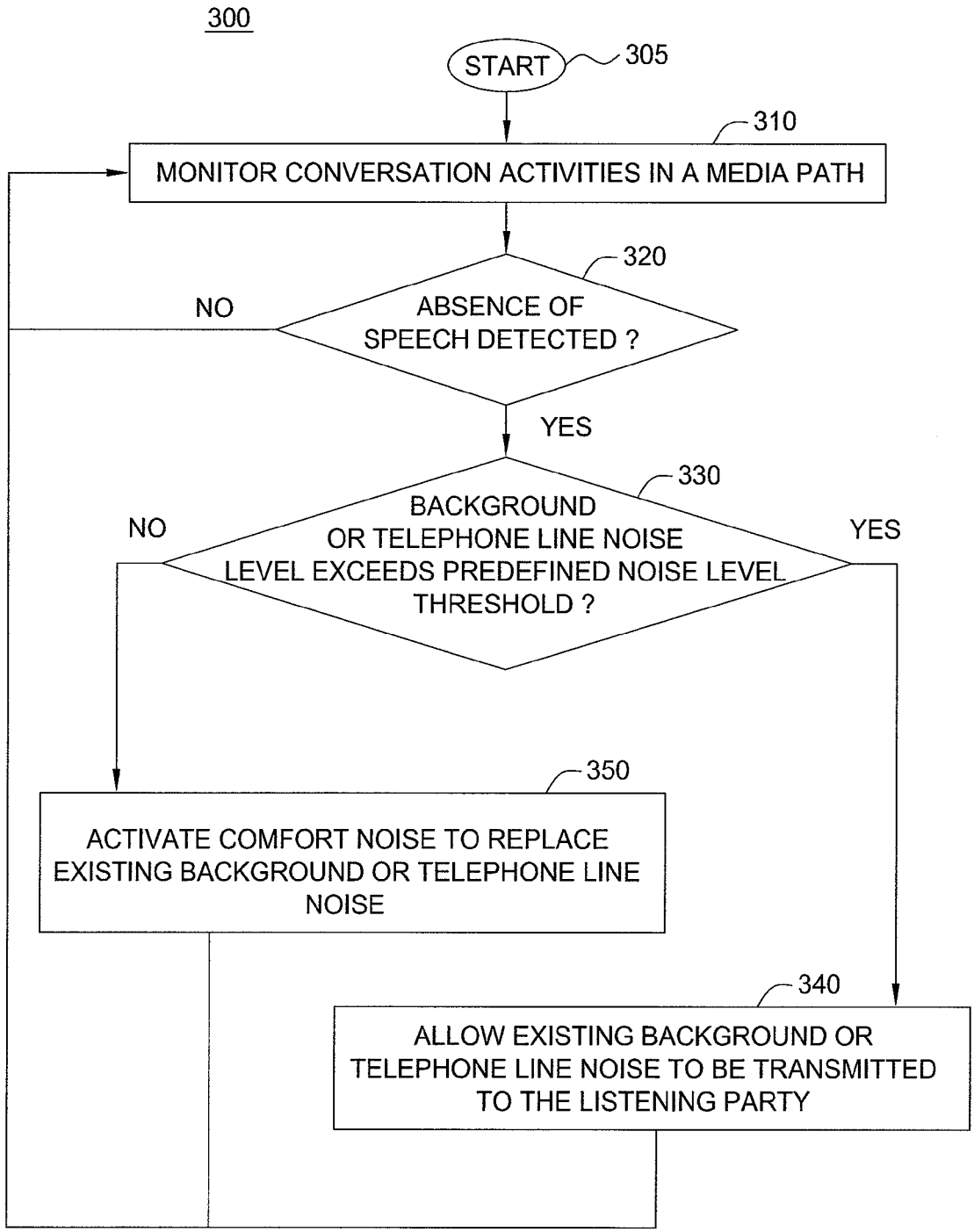
FIG. 3 illustrates a flowchart of a method for dynamically enabling comfort noise in a VoIP network of the present invention.

FIG. 3 illustrates a flowchart of a method 300 for dynamically enabling comfort noise in a packet network, e.g., a VoIP network of the present invention. Method 300 starts in step 305 and proceeds to step 310.

In step 310, the method monitors conversation activities, such as absence of speech period, presence of speech period, and background noise level, in the media path.

In step 320, the method checks if an absence of speech is detected. If absence of speech is detected, the method proceeds to step 330; otherwise, the method proceeds back to step 310.

In step 330, the method checks if the background noise or the telephone line noise level in the absence of speech exceeds a predefined noise level threshold. The predefined noise level threshold is a configurable parameter set by the network operator. If the background noise of the telephone line noise level in the absence of speech exceeds the predefined threshold, the method proceeds to step 340; otherwise, the method proceeds to step 350.

In step 340, the method allows existing background noise or telephone line noise to be transmitted to the listening party without inserting comfort noise in the media path. The method then proceeds back to step 310.

In step 350, the method replaces the existing background noise or telephone line noise with comfort noise and transmits the comfort noise to the listening party. The method then proceeds back to step 310.

Figure 4:
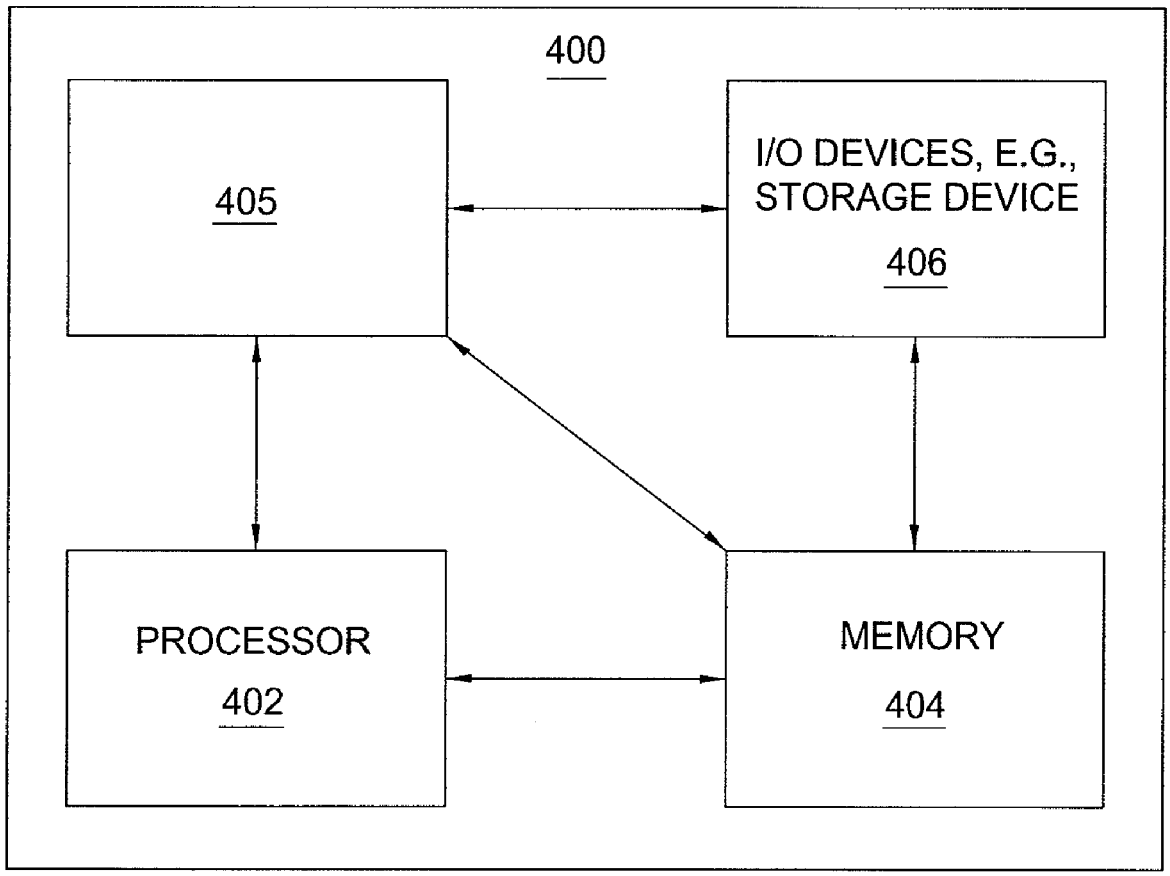
FIG. 4 illustrates a high level block diagram of a general purpose computer suitable for use in performing the functions described herein.

FIG. 4 depicts a high level block diagram of a general purpose computer suitable for use in performing the functions described herein. As depicted in FIG. 4, the system 400 comprises a processor element 402 (e.g., a CPU), a memory 404, e.g., random access memory (RAM) and/or read only memory (ROM), a dynamically enabling comfort noise module 405, and various input/output devices 406 (e.g., storage devices, including but not limited to, a tape drive, a floppy drive, a hard disk drive or a compact disk drive, a receiver, a transmitter, a speaker, a display, a speech synthesizer, an output port, and a user input device (such as a keyboard, a keypad, a mouse, and the like)).

It should be noted that the present invention can be implemented in software and/or in a combination of software and hardware, e.g., using application specific integrated circuits (ASIC), a general purpose computer or any other hardware equivalents. In one embodiment, the present dynamically enabling comfort noise module or process 405 can be loaded into memory 404 and executed by processor 402 to implement the functions as discussed above. As such, the present dynamically enabling comfort noise process 405 (including associated data structures) of the present invention can be stored on a computer readable medium or carrier, e.g., RAM memory, magnetic or optical drive or diskette and the like.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method for providing a comfort noise in a communication network, comprising:

monitoring via a border element or via a speech activity detector attached to the border element speech activities in a call media path;

monitoring via the border element or via the speech activity detector attached to the border element a background noise level or a telephone line noise level in the call media path; and introducing via the border element or via the speech activity detector attached to the border element dynamically a comfort noise if an absence of speech period is detected on the call media path and the background noise level or the line noise level is below a predefined noise threshold, wherein the introducing comprises:

replacing the background noise or the telephone line noise with the comfort noise during the absence of speech period if the background noise or the telephone line noise level is below the predefined noise threshold; and transmitting the background noise or the telephone line noise without introducing the comfort noise during the absence of speech period if the background noise or the telephone line noise level exceeds the predefined noise threshold.

2. The method of claim 1, wherein the communication network comprises a packet network.

3. The method of claim 2, wherein the packet network comprises an internet protocol network.

4. The method of claim 1, wherein the predefined noise threshold is a configurable parameter set by an operator of the communication network.

5. A non-transitory computer-readable medium having stored thereon a plurality of instructions, the plurality of instructions including instructions which, when executed by a processor, cause the processor to perform a method for providing a comfort noise in a communication network, comprising:

monitoring via a border element or via a speech activity detector attached to the border element speech activities in a call media path;

monitoring via the border element or via the speech activity detector attached to the border element a background noise level or a telephone line noise level in the call media path; and introducing via the border element or via the speech activity detector attached to the border element dynamically a comfort noise if an absence of speech period is detected on the call media path and the background noise level or the line noise level is below a predefined noise threshold, wherein the introducing comprises:

replacing the background noise or the telephone line noise with the comfort noise during the absence of speech period if the background noise or the telephone line noise level is below the predefined noise threshold; and transmitting the background noise or the telephone line noise without introducing the comfort noise during the absence of speech period if the background noise or the telephone line noise level exceeds the predefined noise threshold.

6. The non-transitory computer-readable medium of claim 5, wherein the communication network comprises a packet network.

7. The non-transitory computer-readable medium of claim 6, wherein the packet network comprises an internet protocol network.

8. The non-transitory computer-readable medium of claim 5, wherein the predefined noise threshold is a configurable parameter set by an operator of the communication network.

9. An apparatus for providing a comfort noise in a communication network, comprising:

means for monitoring via a border element or via a speech activity detector attached to the border element speech activities in a call media path;

means for monitoring via the border element or via the speech activity detector attached to the border element a background noise level or a telephone line noise level in the call media path; and means for introducing via the border element or via the speech activity detector attached to the border element dynamically a comfort noise if an absence of speech period is detected on the call media path and the background noise level or the line noise level is below a predefined noise threshold, wherein the means for introducing comprises:

means for replacing the background noise or the telephone line noise with the comfort noise during the absence of speech period if the background noise or the telephone line noise level is below the predefined noise threshold; and means for transmitting the background noise or the telephone line noise without introducing the comfort noise during the absence of speech period if the background noise or the telephone line noise level exceeds the predefined noise threshold.

10. The apparatus of claim 9, wherein the communication network comprises a packet network.

11. The apparatus of claim 10, wherein the packet network comprises an internet protocol network.

12. The apparatus of claim 9, wherein the predefined noise threshold is a configurable parameter set by an operator of the communication network.

* * * * *